United States Patent [19]

DePagter

[11] 4,116,093

[45] Sep. 26, 1978

[54] DRIVE MECHANISM FOR POWER RATCHET WRENCH

[75] Inventor: Glenn H. DePagter, Spring Lake, Mich.

[73] Assignee: Gardner-Denver Company, Dallas, Tex.

[21] Appl. No.: 868,658

[22] Filed: Jan. 11, 1978

Related U.S. Application Data

[63] Continuation of Ser. No. 743,997, Nov. 22, 1976, abandoned.

[51] Int. Cl.[2] ..... B25B 13/46

[52] U.S. Cl. ..... 81/57.39

[58] Field of Search ..... 81/57.39, 57.46; 227/131, 132; 173/123, DIG. 3; 74/89.15, 24, 84 R

[56] References Cited

U.S. PATENT DOCUMENTS

| | | | |
|---|---|---|---|
| 2,119,968 | 6/1938 | Shaff | 81/57.39 |
| 2,264,012 | 11/1941 | Wasson | 81/57.39 |
| 3,570,331 | 3/1971 | Rogers | 81/57.39 |

*Primary Examiner*—James L. Jones, Jr.
*Attorney, Agent, or Firm*—Michael E. Martin

[57] ABSTRACT

The drive mechanism of a power ratchet wrench includes a rotary cam which engages a drive ball which in turn is engaged with a push rod for rotating the wrench socket. The push rod is formed with a spherical seat for engaging the drive ball and the cam includes an annular surface which is concavely curved to provide a seat for the drive ball. The drive ball reciprocates in an axial bore in the wrench housing.

6 Claims, 6 Drawing Figures

DRIVE MECHANISM FOR POWER RATCHET WRENCH

This is a continuation of application Ser. No. 743,997 filed Nov. 22, 1976, now abandoned.

BACKGROUND OF THE INVENTION

The present invention pertains to improvements in power operated wrenches which have a drive mechanism which intermittently rotates a wrench socket or the like. Such tools are also commonly known as ratchet wrenches.

Prior art power ratchet wrench drive mechanisms are known in which a rotary cam actuates a push rod by means of an intermediate member such as a roller or the like. A mechanism which is popular is generally of the type disclosed in U.S. Pat. No. 2,119,968. However, it has been determined that certain improvements are desirable in power rachet wrenches which will increase the useful life of the wrench mechanism and reduce the manufacturing cost thereof. For example, prior art drive mechanisms of the general type referred to hereinabove develop damaging lateral forces due to the arrangement of the cam, cam follower, and push rod return spring. Moreover, the roller type cam follower is subject to wear as is the rotary cam surface due to lateral movement of the push rod during operation. Furthermore, many prior art ratchet wrench mechanisms are not easily lubricated sufficiently to reduce wear and friction which is otherwise likely to contribute to early mechanism failure.

SUMMARY OF THE INVENTION

The present invention provides a drive mechanism for a power ratchet wrench or the like wherein the movement of the working parts does not create unusually severe forces and wear on the parts themselves and the direction of the forces on the drive elements results in more effective operation of the wrench.

The present invention also provides a drive mechanism for a power ratchet wrench or the like wherein the conversion of rotary motion of a cam to reciprocation of a push rod is accomplished with reduced friction and wear on the working parts. With the drive mechanism of the present invention damaging lateral forces are substantially eliminated and the useful life of the working parts is greatly increased in comparison with heretofore known mechanisms.

The wrench drive mechanism of the present invention further includes improved means for lubricating the working parts and for sealing the drive mechanism from exposure to external contaminates. Moreover, the drive mechanism of the present invention is made up of rugged, easily fabricated parts which are few in number.

DESCRIPTION OF THE PREFERRED EMBODIMENTS

Figure 1:
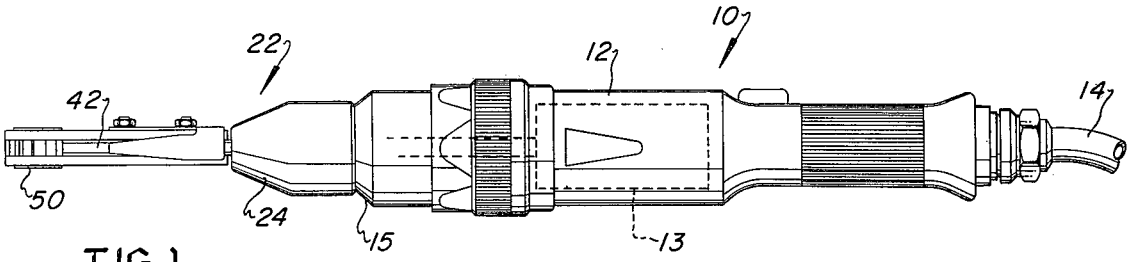
FIG. 1 is a longitudinal plan view of a power wrench including the drive mechanism of the present invention.
Figure 2:
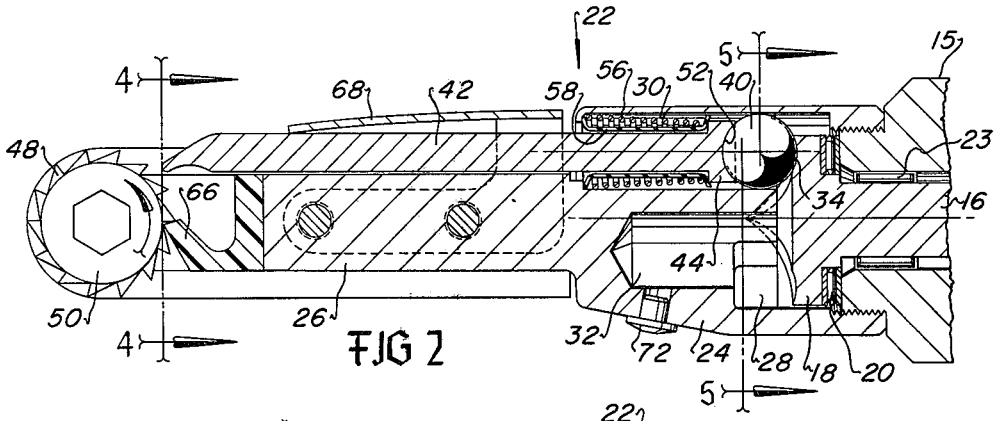
FIG. 2 is a longitudinal section view of the wrench drive mechanism.

Referring to FIG. 1 the wrench mechanism of the present invention is adapted for use in a hand-held fluid operated ratchet wrench, generally designated by the numeral 10. The wrench includes a casing 12 for a pneumatic motor 13 of a well known type. Pressure fluid, such as compressed air, is supplied to the wrench 10 by a flexible hose 14. Referring to FIG. 2 also, the casing 12 is characterized by a distal end portion 15 in which is rotatably supported a spindle 16. The spindle 16 is suitably connected to the wrench motor to be rotatably driven thereby. The spindle 16 is rotatably mounted in the casing 12 in suitable bearings 20 and 23.

Figure 3:
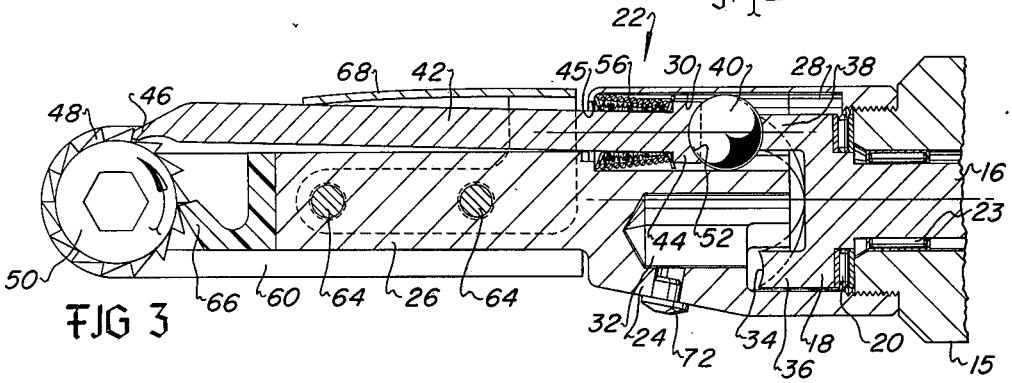
FIG. 3 is a view similar to FIG. 2 showing the wrench mechanism in a different operating position.

The spindle 16 is part of an improved drive mechanism for the wrench 10, and which is generally designated by the numeral 22. The drive mechanism 22 includes a housing 24 which is removably secured to the wrench casing 12 and is further characterized by an elongated beam portion 26. The housing 24 also is formed to have a partially annular interior chamber 28. The housing 24 is further characterized by a longitudinal cylindrical bore 30, the central axis of which is displaced from but substantially parallel to the axis of rotation of the spindle 16. A second longitudinal bore or chamber 32 is also formed in the housing and serves as a lubricant reservoir. The spindle 16 includes a head portion comprising an annular cam 18 which has a concave surface 34 as shown in FIG. 3. The cam 18 is formed to have two axially projecting lobes 36 and 38 disposed opposite one another or about 180° apart. The cam 18 is engageable with a cam follower comprising a spherical ball 40 which is disposed in the bore 30. The curvature of the ball 40 is substantially the same as the curvature of the concave surface 34 on the cam 18. The ball 40 is engaged with an elongated actuating rod 42 having a head portion 44 disposed in the bore 30. The rod 42 extends through an opening 45 in the end of bore 30 and includes a tip 46 which is engageable with ratchet teeth 48 formed on the circumference of a rotatable wrench socket 50. The head portion 44 has a concave spherical surface 52 of substantially the same curvature as the curvature of the ball 40. The rod 42 is biased into engagement with the ball 40 by a conical coil spring 56 disposed substantially coaxially around the rod and within the bore 30. A flexible tubular seal 58 is retained in the bore 30 by the spring 56 for sealing the chamber 28 from exposure to the environment surrounding the tool 10. A so-called U-cup type of sealing member, not shown, could be used instead of the sealing member 58. The U-cup seal would be disposed around the rod 42 and retained between the head portion 44 and the spring 56.

Figure 4:
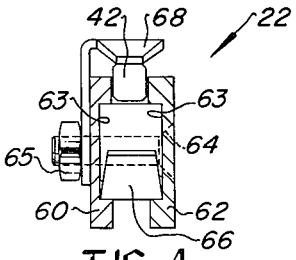
FIG. 4 is a section view taken along the line 4–4 of FIG. 2.
Figure 5:
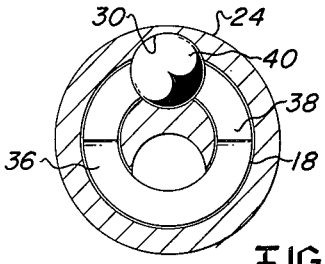
FIG. 5 is a section view taken along the line 5–5 of FIG. 2.

Referring to FIGS. 1, 2 and 4 the drive mechanism 22 also includes a pair of opposed elongated plates 60 and 62 each of which are formed with a longitudinal slot or channel 63 so that the plates may be fitted over the elongated housing portion 26 and secured thereto by suitable conical recessed head screw fasteners 64 and complementary nuts 65. The fasteners 64 and 65 may be modified so as to not project substantially beyond the outer surface of the plates. The spaced apart plates 60 and 62 also in a conventional manner, retain the rotatable socket 50 therebetween as well as a pawl 66 which operates to prevent reverse rotation of the socket. The pawl 66 may be suitably formed by an elastic material, such as polyurethane. In response to reciprocating movement of the rod 42 to move the socket in the direction of the arrows in FIGS. 2 and 3 the pawl 66 is deflected by the ratchet teeth 48. However, the pawl 66 engages the teeth sufficiently to prevent any substantial movement of the socket in the reverse direction. The rod 42 is continually biased toward engagement with the teeth 48 by a cantilever leaf spring 68 which is secured to the plate 60 by the fasteners 64.

Thanks to the arrangement of the ball 40 disposed in the bore 30 for axial reciprocating movement only, the cooperating cam 18, and the arrangement of the rod 42, damaging lateral forces on the drive mechanism 22 are substantially eliminated. The surfaces 34 and 52 on the cam 18 and rod 42, respectively, provide for large contact areas for engagement with the ball 40 due to their curvature being substantially the same as the ball. Moreover, the arrangement of the rod 42 with the socketlike surface 52 which cooperates with the ball 40 provides for pivotal movement of the rod as the socket 50 is rotated without reducing the surface contact between the cooperating ball and rod and with a minimum of lateral movement of the rod.

The drive mechanism 22 may be competently lubricated with regard to the cooperating parts disposed in the housing 24 by injecting grease into the reservoir 32 and chamber 28 through a suitable grease fitting 72 or the like. Since the chamber 28 is substantially sealed from exposure to the exterior of the housing 24, loss of lubricant is nil and the risk of contamination is minimized.

Figure 6:
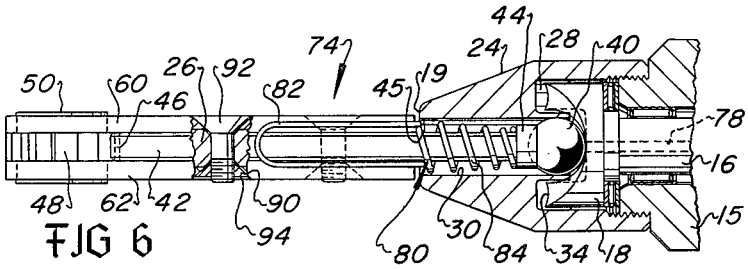
FIG. 6 is a longitudinal elevation partially sectioned showing an alternate embodiment of the wrench drive mechanism.

Referring to FIG. 6, an alternate embodiment of the wrench drive mechanism is illustrated and generally designated by the numeral 74. The drive mechanism 74 is modified in regard to the method of lubrication wherein lubricant entrained in the pressure air admitted to the wrench is used to lubricate the coacting surfaces on the cam 18, ball 40, and rod 42. A portion of the air exhausted from the aforementioned tool motor is conducted into the chamber 28 through a central axial passage 78 formed in the spindle 16. The air then flows over the surfaces of the ball 40, cam 18, and the head portion 44 of the rod before existing through the opening 45 in the housing. The drive mechanism 74 does not have a sealing member in the bore 30 but risk of contamination of the chamber 28 with foreign matter is minimized by the substantially constant outflow of exhaust air during wrench operation.

The drive mechanism 74 illustrated in FIG. 6 is also characterized by a spring 80 which is formed of one continuous piece of spring wire. The spring 80 has an elongated cantilever portion 82 which biases the rod laterally toward the socket 50. The spring 80 also includes a conical coil portion 84 which acts on the head 44 of the rod to bias the rod into engagement with the ball 40. The spring 80 may be retained on the housing by projecting portions which fit on both sides of the housing part 26 and between the plates 60 and 62 and the nose 19 of the housing 24.

The drive mechanism 74 is further modified to include improved means for fastening the side plates 60 and 62 to the housing portion 26. The side plate 62 is adapted to have conical recesses like the side plate 60 for receiving conical nuts 90 which together with flat head screws 92 similar to the screw fasteners 64 hold the side plates in assembled relationship with the housing portion 26. In the embodiment of FIG. 6 the side plates may in fact be identical. The nuts 90 may be provided with slots 94 to assist in tightening or disassembling the fasteners. The arrangement of the fasteners 90 and 92, which are substantially flush with the longitudinal exterior of the plate members, provides for a reduced thickness of the drive mechanism 74 to facilitate usage of the wrench where clearance for the drive mechanism is very limited.

The drive mechanisms 22 and 74 operate substantially in the same manner. The spindle 16 is rotatively driven by the wrench motor which causes the cam 18 to rotate thereby effecting reciprocating movement of the ball 40 and the rod 42. As the rod 42 is advanced toward the socket 50 the end portion 46 engages one of the ratchet teeth 48 and causes incremental rotation of the socket until the ball 40 reaches the peak of a lobe of the cam. The cantilever spring 68 or 82 operates to bias the rod into firm engagement with the ratchet teeth 48. As the ball 40 traverses the cam surface away from the peak of one lobe and toward the other the spring 56 or 80 retracts the rod 42 away from the socket 50 and holds the rod in contact with the ball. The spring, of course, also operates to bias the ball 40 toward engagement with the cam surface 34 at all times. The cam 18, ball 40, and rod 42 thereby effect rapid and intermittent rotation of the socket 50. Since the head portion 44 of the rod is subject to very small lateral displacement inertia forces and the resultant vibration and damaging wear is substantially reduced on the cooperating parts of the drive mechanisms 22 and 74. Moreover, the other advantages of the present invention described hereinabove will be appreciated by those skilled in the art of power wrenches.

What is claimed is:

1. A drive mechanism for a power ratchet wrench or the like comprising:

a rotatable spindle;

a housing including an interior chamber and means for supporting a toothed rotary ratchet socket;

a circular cam formed on said spindle and including at least one cam lobe projecting axially with respect to the axis of rotation of said spindle, said cam being disposed in said chamber;

a cylindrical bore in said housing and intersecting said chamber, the central axis of said bore being spaced from and substantially parallel to the axis of rotation of said spindle;

a spherical cam follower disposed in said bore for reciprocating movement in response to the rotation of said cam by said spindle;

an actuating member supported by said housing, said actuating member having an end portion adapted to be engaged by said cam follower and an opposite end portion engageable with said toothed socket for intermittent rotation of said socket in response to the rotation of said cam; and, resilient means disposed in said bore and engaged with said actuating member for biasing said actuating member and said cam follower into engagement with said cam.

2. The invention set forth in claim 1 wherein:

said cam includes an annular cam surface for engaging said cam follower, said cam surface being concave and having a transverse curvature substantially the same as the curvature of said cam follower.

3. The invention set forth in claim 1 wherein:

said actuating member comprises an elongated rod having a head portion disposed in said bore, said head portion including a concave surface for engagement with said cam follower.

4. The invention set forth in claim 3 wherein:

said concave surface has a curvature which is substantially the same as the spherical curvature of said cam follower.

5. The invention set forth in claim 1 wherein:

said resilient means comprises a coil spring disposed in said bore around and engaged with said actuating member.

6. The invention set forth in claim 5 wherein:

said coil spring includes an elongated cantilever portion for engaging said actuating member to bias said actuating member into engagement with said socket.

* * * * *